United States Patent [19]

Saito

[11] 4,014,252

[45] Mar. 29, 1977

[54] METHOD OF MANUFACTURING BAGS

[75] Inventor: Akio Saito, Tokorozawa, Japan

[73] Assignee: Show Seitai Kogyo Kaisha Ltd., Tokyo, Japan

[22] Filed: Sept. 2, 1975

[21] Appl. No.: 609,731

[52] U.S. Cl. ..... 93/35 R; 93/8 W

[51] Int. Cl.[2] ..... B31B 49/04

[58] Field of Search ..... 93/35 R, 8 W, 14, 17, 93/18, 19, 20, 21, 22, 26, 27, 8 R; 229/55

[56] References Cited

UNITED STATES PATENTS

| | | | |
|---|---|---|---|
| 2,622,786 | 12/1952 | McDowell | 93/35 R X |
| 2,854,186 | 9/1958 | Williams | 229/55 |
| 3,129,848 | 4/1964 | Canno | 229/55 |
| 3,680,445 | 8/1972 | Pearl et al. | 93/35 R |

*Primary Examiner*—James F. Coan
*Attorney, Agent, or Firm*—Wenderoth, Lind & Ponack

[57] ABSTRACT

In a method of manufacturing a bag wherein the side edges of a continuous web of the blank are bonded together to form a flat tubular body, the tubular body is cut along spaced cutting lines to form a plurality of sections each having a length substantially equal to the length of a completed bag and one ends of respective sections are closed, reinforcing members are bonded to the blank with their intermediate portions aligned with the cutting lines and then the blank is cut along the cutting lines together with the reinforcing members to form the sections.

5 Claims, 14 Drawing Figures

METHOD OF MANUFACTURING BAGS

BACKGROUND OF THE INVENTION

This invention relates to a method of manufacturing a bag with a reinforced opening.

A multi-layered bag with side folds whose opening is to be closed by sewing has been manufactured by a method comprising the steps of superposing two or more elongated webs of the bag blank, folding back the respective side edges of the superposed webs, bonding these respectively folded back side edges to form a continuous tubular body, successively cutting the tubular body into sections (each having the length of one bag), and closing one end of each section by sewing.

These bags usually comprise two or more superposed layers and have satisfactory strength and capability of preserving their shapes for many applications.

However, it is a recent trend to decrease the number of superposed layers for the purpose of saving the material. As a result of my investigation, even when the number of the superposed layers is decreased, it was found that the strength of the body portion of the bag is sufficient for most applications but there still remain problems regarding the opening of the bag.

One problem involves insufficient stiffness of the opening due to shortage of the rigidity of the opening. For this reason, when the opening is closed by an automatic packing machine after filling the contents in the bag, the workability of the machine decreases. More particularly, if respective layers were neatly aligned at the opening after the contents have been packed in the bag, sewing of the opening could be performed without any trouble. Actually, however, since the respective layers are not neatly aligned at the opening, the percentage of rejects increases.

Another problem involves an extreme decrease in the strength of the opening which is fatal to certain applications. To reinforce the opening of multi-layer bag with side folds, a reinforcing sheet of paper 30 was applied to the opening of the bag as shown in FIG. 5 and then secured thereto by sewing. The reinforcing sheet of paper does not extend to the side fold 32 and when the folds are expanded outwardly by the packed contents, the strength of the bag decreases at the opening.

SUMMARY OF THE INVENTION

It is an object of this invention to provide a novel method of manufacturing a bag capable of obviating the difficulties described above.

Another object of this invention is to manufacture bags with openings having sufficient rigidity and mechanical strength which can withstand the operation of an automatic bag manufacturing machine.

According to this invention, these and other objects can be accomplished by providing a method of manufacturing a bag comprising the steps of continuously paying out a continuous web of a blank, bonding together the side edges of the blank to form a tubular body, cutting the tubular body along spaced cutting lines to form a plurality of sections (each having a length substantially equal to the length of a completed bag), and closing one end of respective sections. The present invention is characterized by the steps of bonding reinforcing members to the blank with the intermediate portions of the reinforcing members aligned with the cutting lines and then cutting the blank along the cutting lines together with the reinforcing members to form the sections.

When the blank comprises a single layer, the reinforcing members are bonded to one side or the other of the blank, whereas where the blank comprises two or more layers the reinforcing members are interposed between and bonded to the layers.

BRIEF DESCRIPTION OF THE DRAWINGS

The invention can be more fully understood from the following detailed description taken in conjunction with the accompanying drawings in which.

DESCRIPTION OF THE PREFERRED EMBODIMENTS

Figure 1:
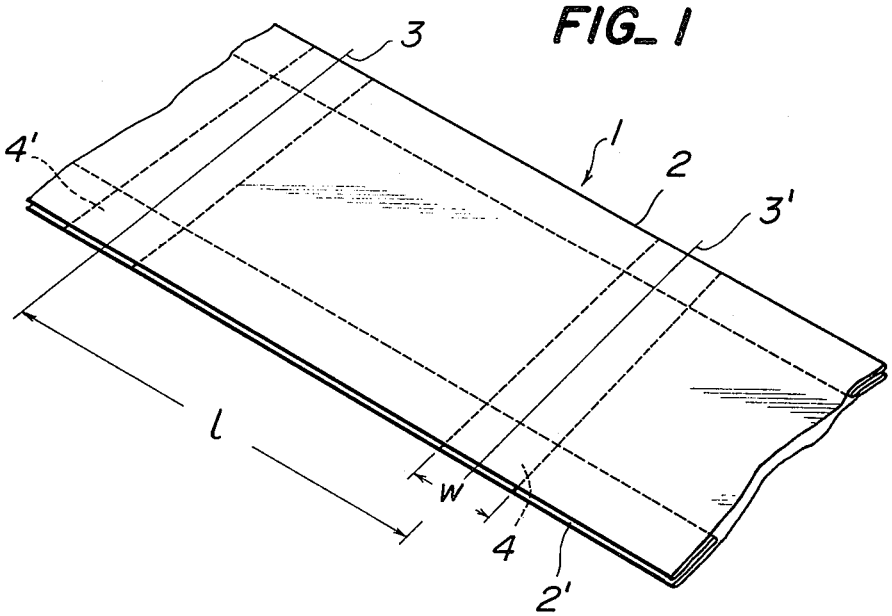
FIG. 1 is a perspective view showing a continuous and flattened tubular body utilized to manufacture bags according to the method of this invention.
Figure 2:
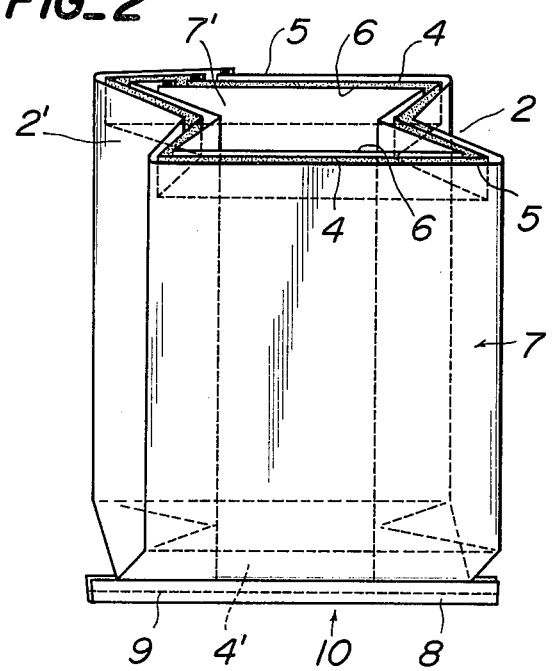
FIG. 2 is a perspective view of a multi-layer bag with side folds manufactured according to the method of this invention.
Figure 3:
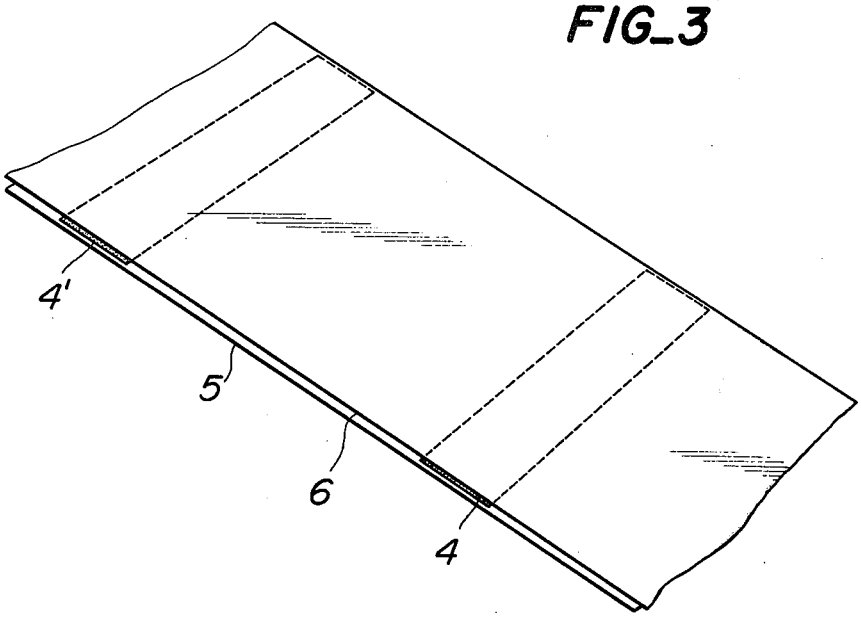
FIG. 3 is a perspective view showing two superposed webs with reinforcing members interposed therebetween.

Referring now to FIG. 1, there is shown a continuous flattened tubular body 1 provided with side folds 2 and 2' along longitudinal edges for the purpose of providing a desired thickness to the completed bags. Usually, the tubular body is formed by superposing two or more layers of webs of blanks 5 and 6 (see FIG. 3), for example by concurrently paying out a plurality of web from rolls, with their ends slightly displaced in the longitudinal direction, then forming folds along the side edges and bonding together the folded side edges to form the tubular body. The above described process is performed by a well-known bag manufacturing machine. Such tubular body is then cut along cutting lines 3 and 3' (see FIG. 1) to form sections each having a length of one completed bag. One end of each section of the tubular body is sewed to complete a multi-layer bag with one end closed.

According to the method of this invention, reinforcing members 4 and 4' (see FIG. 3) having a length equal to the width of the webs and a predetermined width W are interposed between the webs prior to cutting. In the example shown in FIG. 1, the tubular body is cut along substantially the center lines of the respective reinforcing members 4 and 4'. Accordingly, in the case of a two-layer bag as shown in FIG. 1, the reinforcing members 4 and 4' are interposed between the outer layer 5 and the inner layer 6 around the entire periphery of the opening 7' of the completed bag 7. Of course, the reinforcing members 4 and 4' are also interposed at the side folds 2 and 2'.

Generally, insertion of the reinforcing members 4 and 4' is performed by inserting and bonding the members 4 and 4' having the desired width between blanks 5 and 6 before they are formed into a tubular body by an automatic bag manufacturing machine. The reinforcing members and the blanks 5 and 6 may be made of sheets of papers but preferably they are made of plastic laminates to impart wet proofness as will be described later.

Figure 4:
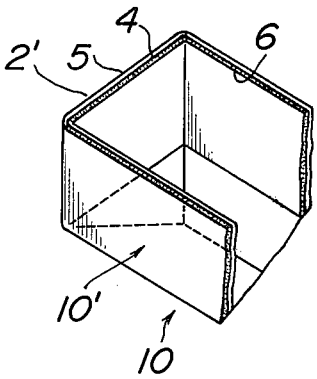
FIG. 4 is a perspective view of a portion of the bottom of a completed bag.
Figure 5:
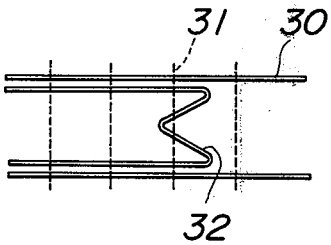
FIG. 5 shows a section of the bottom of the bag with side folds reinforced by the prior art method.

Another reinforcing member 8, for example made of paper, is applied for one end of each cut section and sewed thereto as at 9 to form a closed bottom 10. When the contents are packed in the bag 7, the side folds 2 and 2' are expanded outwardly as shown in FIG. 4 whereby the cross-sectional configuration of the body portion of the bag becomes rectangular, and the vertical sectional configuration of the bottom becomes triangular. However, the reinforcing member 4 is interposed between blanks 5 and 6 about the entire periphery of the bottom 10, so that the strength of the bottom is large.

Since the reinforcing member 4 is also used at the triangular portion 10' which is formed as a result of expanding the folds, the strength of the bottom which has been considered to be the weakest portion of the bag is increased, thereby eliminating the trouble described above.

Also at the opening of the bag, the reinforcing member 4 is interposed between the blanks 5 and 6 around the entire periphery of the opening so that the capability of preserving the shape of the opening is increased. Accordingly, it is easy to process the bag with an automatic packing machine with a small percentage rejects.

Although in the foregoing embodiment, the reinforcing members 4 have been interposed between the layers of the blanks 5 and 6 it will be clear that the invention is not limited to such specific construction. For example, where a film of a synthetic resin having a large strength, for example, a resinous film elongated along two orthogonal axes, (for example those sold under a Trademark Valeron) is used, only one layer of the blank may be used in which case the reinforcing members may be applied to one surface of the film. Where the bag comprises two layers of the resinous film the reinforcing members may be applied to the inner surface of the inner layer or to the outer surface of the outer layer or to the inner and outer surfaces of the inner and outer layers.

Further in the foregoing embodiment, the invention was applied to a bag provided with folds on both side edges but it will be clear that the invention is also applicable to a bag of a simple construction having no side fold.

Although it is preferred to close the opening 7' of the bag by sewing as at the bottom, such opening can be closed by using a suitable bonding agent.

Recently, in the manufacture of heavy duty packing bags, woven cloths having a high shock proofness and made of films elongated along two orthogonal axes (Trademark Valeron), elongated PP or elongated PE and coated with a resin of the same type are used in single, two or three layers. However, as these materials are made of resin, it is difficult to bond together the layers with conventional bonding agent so that it is necessary to use a special bonding agent of the two liquid type. Moreover, it is difficult to close the bottom of the bag by mechanical operation.

The invention utilizes the fact that so long as the blanks are flat it is possible to bond them together by a binder of the hot melt type. The reinforcing members are bonded to the blanks while they are maintained in flat condition.

Figure 6:
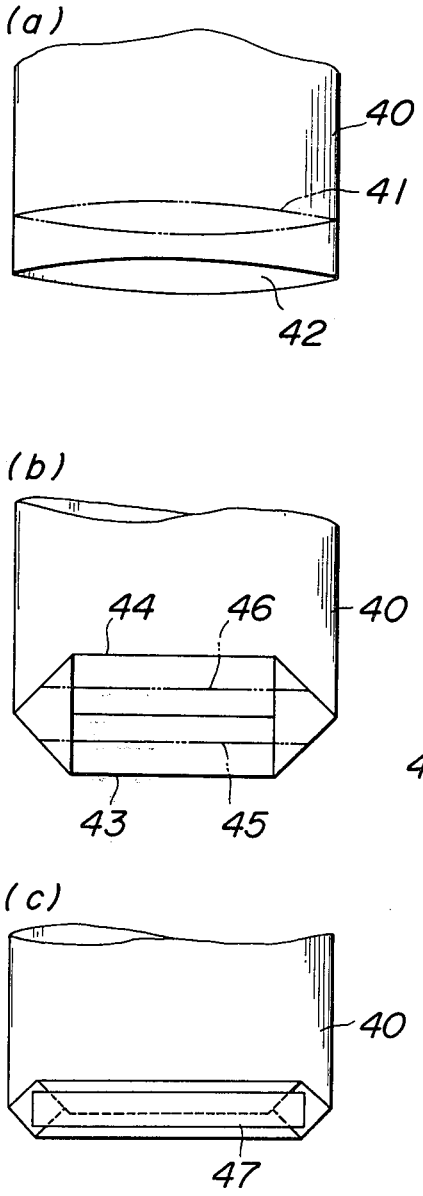
FIGS. 6*a*, 6*b* and 6*c* are plan views showing successive steps of forming the bottom portion of a bag according to a prior art method.
Figure 7:
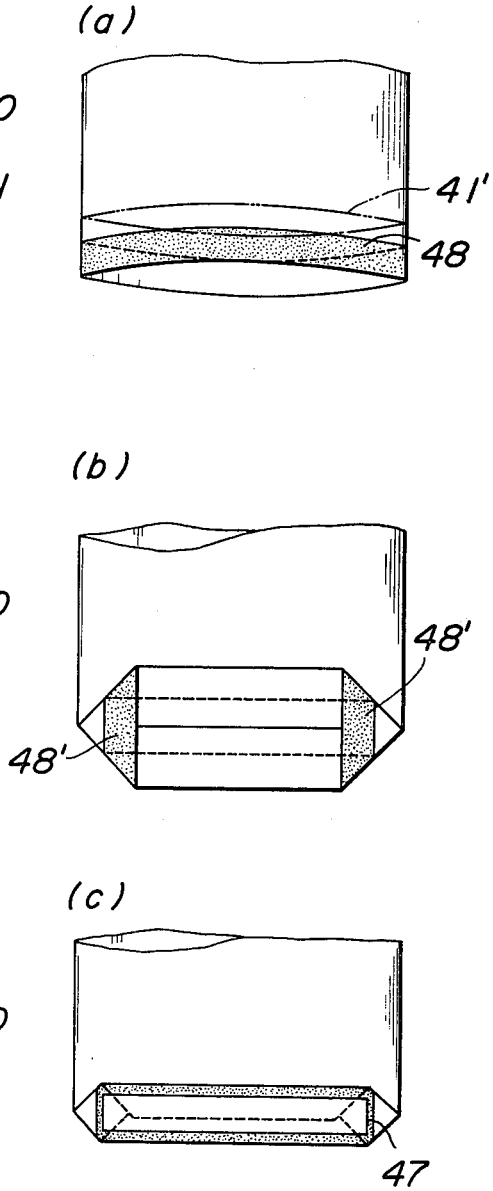
FIGS. 7*a*, 7*b* and 7*c* are plan views corresponding to FIGS. 6*a*, 6*b* and 6*c* respectively showing the steps of manufacturing the bottom portion of a bag according to this invention.

According to a prior art method of manufacturing bags, after forming a flattened tubular body 40, one end thereof is bent upward along a line 41 shown in FIG. 6*a* and the blanks on the opposite sides of the line 41 are separated away as shown in FIG. 6*b*. Then these separated portions 43 and 44 are folded toward each other along lines 45 and 46 as shown in FIG. 6*c*. A reinforcing member 47 is bonded to these folded portions to complete the bottom of the bag.

Where a reinforcing member is bonded to the outer surface of the blank the steps shown in FIGS. 6*a*, 6*b* and 6*c* are shown by FIGS. 7*a*, 7*b* and 7*c* respectively.

More particularly, a reinforcing member 48 is bonded around the entire periphery of the bottom opening of the bag. In the step shown in FIG. 7*b* the reinforcing member appears on both sides 48' and in the step shown in FIG. 7*c*, the reinforcing member appears on the entire surface to which another reinforcing member 47 is to be bonded. Even when a blank which is difficult to bond, for example the Valeron described above, is used when the reinforcing member 48 of paper has a good bondability it is possible to greatly improve the workability of forming the bottom. More particularly, the reinforcing member 48 can be readily bonded to the blank by using a hot melt type bonding agent while maintaining the blank in a flat state. Where a composite sheet of paper and resinous film is used as the another reinforcing member 47 it can be readily bonded to the reinforcing member 48 since the bonding therebetween comprises paper to paper bonding. Such bonding can be prepared by using an ordinary inexpensive bonding agent. Since the resinous film of the reinforcing member 47 appears outside, the appearance of the bottom is excellent.

Figure 8:
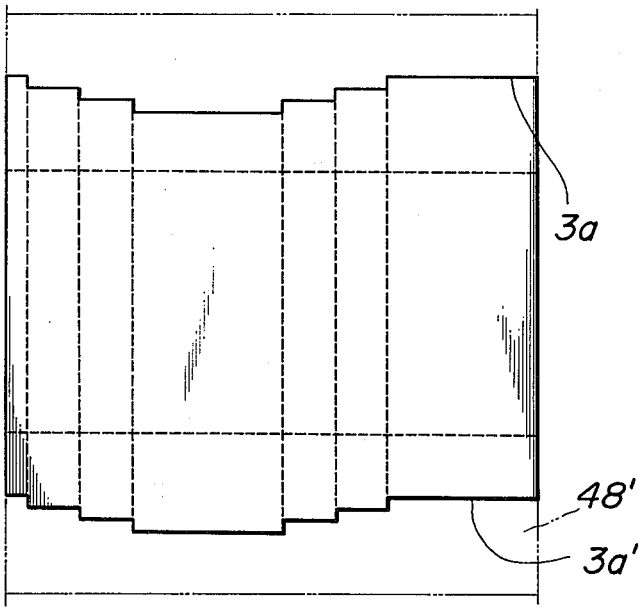
FIG. 8 is a plan view of a blank showing the first step of manufacturing a bag according to a modified method of this invention.
Figure 9:
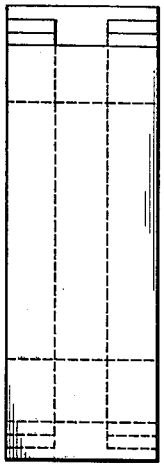
FIG. 9 is a plan view of a flat tubular body prepared by using the blank shown in FIG. 8
Figure 10:
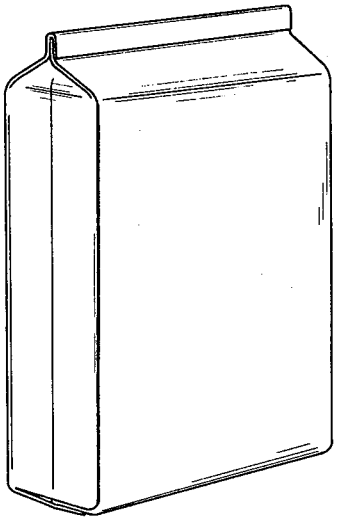
FIG. 10 is a perspective view of a completed bag with its upper opening closed after filling the contents.

In another modification of this invention, a blank of the bag was cut along stepped cutting lines 3*a* and 3*a'* as shown in FIG. 8 and the resulting blank was shaped into a flat tubular body having irregular edges at both ends as shown in FIG. 9. The bottom opening is closed by a formet bonding agent whereas the same bonding agent is applied to the top edge and then reactivated by blasting hot air thus obtaining a so-called pinch bag which can be sealed after packing the contents in the bag as shown in FIG. 10. In this case also a reinforcing paper 48' is applied to the outer surface of the bag so as to bridge both cutting lines 3*a* and 3*a'*. Since the surface to be bonded together at the opening is constituted by the reinforcing paper 48' when the hot melt type bonding agent is applied to the opening and reactivated by the blank of hot air it is possible to readily seal the opening by using the top sealer which have been used to seal the pinch bags made of paper. Moreover, the bonded reinforcing paper increases the rigidity of the opening thereby assuring smooth charging of the contents. If the reinforcing member 48' were made of a resinous film alone it is difficult to bond it when it is bent. However, use of a sheet of paper for the reinforcing member results in easy bonding.

In still another modification of this invention, the reinforcing member is made of a synthetic resin. Thus, a heat fusible synthetic resin is coated to the portion of the blank to which said reinforcing paper was bonded in the preceding embodiment, and then the flattened tubular body is cut into sections each having a length corresponding to that of one bag. Then the layers of heat fusible resin present at the top and bottom openings around the entire peripheries thereof thus reinforcing these portions. When sealing the top and bottom openings, the resin surface are brought to face each other and are then fused together by heating.

Where the blank is made of a resinous film elongated along two orthogonal axes or a fabric of yarns of synthetic resin, the blank is pliable and lacks rigidity. According to this invention, the top and bottom openings of the bag made of such material are reinforced to withstand mechanical bag manufacturing operations.

The number of layers of the blank is not limited to two or more. In some applications, the number of the layer may be one.

In such case, reinforcing members are applied to one surface of the blank at a predetermined spacing, and after forming a tubular body as above described, the tubular body is cut along a cutting line intermediate the width of each reinforcing member to obtain cut sections each having the length of the completed bag. In this manner, bags wherein reinforcing members are bonded to the upper and bottom openings around the inner or outer peripheries thereof can be obtained.

In the case of a single layer bag not provided with the reinforcing member, the mechanical strength and the stiffness of the opening are much smaller than those of the bags of this invention so that it is difficult to pack the contents in the bag and to handle the bag.

I claim:

1. In a method of manufacturing a bag which comprises the steps of:

continuously playing out a continuous web of a blank;

bonding together the side edges of the blank to form a tubular body;

cutting the tubular body along spaced cutting lines into a plurality of sections each having a length substantially equal to the length of the completed bag;

the improvement comprising:

bonding reinforcing members to said blank, the intermediate portions of said reinforcing members being aligned with said cutting lines;

cutting said blank together with said reinforcing members along said cutting lines to form said sections;

flattening the bottom end of each section;

bending up a portion of said bottom end at right angles;

separating the opposite sides of the bent up end portion;

folding back the separated sides toward each other, said reinforcing member facing outwardly; and bonding another reinforcing member to said first mentioned reinforcing member.

2. The method according to claim 1 wherein each reinforcing member comprises a composite body of a sheet of paper and a synthetic resin film.

3. The method according to claim 1 wherein said blank comprises a plurality of superposed layers, and said reinforcing members are interposed between and bonded to said layers.

4. The method according to claim 1 wherein each reinforcing member is formed by applying a solution of formet resin onto the surface of the blank and then reactivating the layer of the formet resin by heating.

5. The method according to claim 1 wherein each reinforcing member comprises a sheet of paper.

* * * * *